United States Patent [19]

Shindo

[11] Patent Number: 4,726,792

[45] Date of Patent: Feb. 23, 1988

[54] ELECTRICAL CONNECTOR HAVING ELECTRICAL CONTACTS PROVIDED WITH RETENTION MEANS

[75] Inventor: Mikio Shindo, Hachiohji, Japan

[73] Assignee: AMP Incorporated, Harrisburg, Pa.

[21] Appl. No.: 2,044

[22] Filed: Jan. 9, 1987

[30] Foreign Application Priority Data

Feb. 27, 1986 [JP] Japan ..... 61-42784

[51] Int. Cl.[4] ..... H01R 13/432

[52] U.S. Cl. ..... 439/748

[58] Field of Search ..... 339/217 S; 439/744–749

[56] References Cited

U.S. PATENT DOCUMENTS 3,414,871 12/1968 Tuchel ..... 439/748

4,620,766 11/1986 Leonard ..... 339/217 S

FOREIGN PATENT DOCUMENTS 3413115 10/1985 Fed. Rep. of Germany ... 339/217 S

*Primary Examiner*—Gil Weidenfeld

*Assistant Examiner*—Gary F. Paumen

*Attorney, Agent, or Firm*—Ardian J. Larue; David L. Smith

[57] ABSTRACT

An electrical connector comprises a dielectric housing having a passageway extending therethrough and a latching aperture in communication with the passageway. An electrical contact is positioned in the passageway and includes a resilient latch member that has a free end disposed in the latching aperture to retain the contact in the passageway. A projection extends outwardly from the latch member for engagement with an inside surface of the housing so that when a force opposite to the direction of insertion of the contact into the housing is applied to the contact the free end of the latch member is prevented from projecting beyond the outside surface of the housing.

4 Claims, 9 Drawing Figures

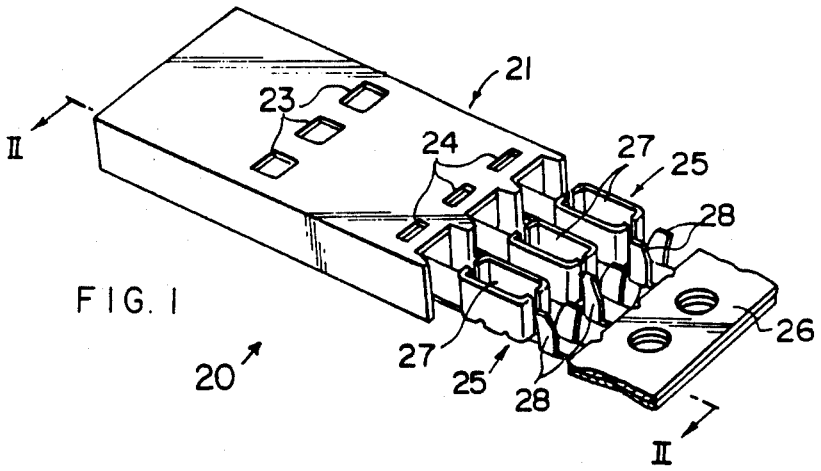
FIG. 1
FIG. 2
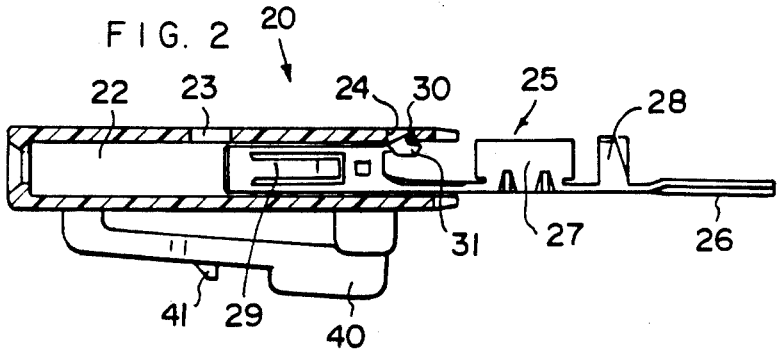
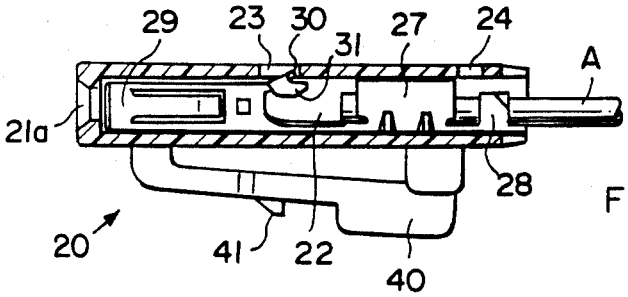
FIG. 3

PRIOR ART

ELECTRICAL CONNECTOR HAVING ELECTRICAL CONTACTS PROVIDED WITH RETENTION MEANS

FIELD OF THE INVENTION

This invention is related to an electrical connector having an electrical contact disposed in a dielectric housing, one end of the contact is connected to, for example, an end portion of an electrical wire, and the other end of which is electrically engageable with a matable electrical contact inside another dielectric housing.

The contact includes a resilient latching member having a projection member that engages an inside surface of the housing thereby preventing the latching member from projecting beyond an outside surface of the housing.

BACKGROUND OF THE INVENTION

Prior art electrical connectors shown in FIGS. 6–8 comprise a connector housing 1 and a plurality of contacts 5, which are retained inside passageways 2 formed inside the housing 1. The contacts 5 include a receptacle portion 9 for electrical engagement with a pin, a connecting portion 7 to which the end of an electrical wire is connected and a clamp 8 to clamp onto the wire. The contact assembly is composed of a plurality of the contacts 5 held in a row by carriers 6. FIG. 6 shows each of the contacts 5 of the contact assembly being partly inserted in the passageways 2 of the connector housing 1, and FIG. 7A is a cross-sectional view showing the connector, along the line VII—VII of FIG. 6. As shown in FIGS. 6 and 7A, at this stage, only the receptacle portion 9 of each contact 5 is inserted in the respective passageway 2, and the connecting portion 7 and clamp 8 are exposed outside the housing 1. At this time, the resilient latching member 10 formed on each contact 5 has its free end projecting inside the temporary holding aperture 4 and retains the contact 5 at this position.

In connecting the electrical wire A to the contact 5, the wire is press-fitted into slots of the connecting portion 7 so that an electrical wire is electrically connected with the connecting portion and retained therein. Next, the clamp 8 is bent over and around the insulation of wire A, and thus the wire A is securely retained in the contact 5 by this clamp 8. Each contact 5 is then completely inserted inside its respective passageway 2 as shown in FIG. 7B whereafter carriers 6 are removed. At this time, the free end of the resilient latching member 10 projects inside a latching aperture 3 formed in the housing 1 and engages with the housing 1, retaining the contacts 5 in position in housing 1. The assembled connector is matable with a complementary electrical connector so that the pins thereof inserted through the insertion apertures 1*a* formed at the front face of the housing 1 engage with the receptacle portions 9 of the contacts 5, and accordingly, electrically connect both connectors.

When using the above-mentioned connector, a pulling force may be applied to the wire A connected to the contact 5, and a problem arises in that the resilient latching member 10 may be bent by this pulling force and projected outward from the latching aperture 3.

In view of this problem, a connector having a contact as shown in FIG. 8 has been proposed. The connector 1 includes the contact 5 with a latching member 10 having bifurcated end portions, one end portion 10*a* extending into the latching aperture 3, and the other end portion 10*b* being disposed inside the passageway 2. Thus, the contact 5 is firmly retained in the passageway by the engagement of the end portions 10*a* and 10*b* with the housing when a pulling force is exerted on the wire connected to the contact 5. Also, the end portion 10*a* of latching member 10 is prevented from projecting beyond the outside surface of the housing when subjected to a certain amount of pulling force. However, when the wire is subjected to a strong pulling force, the end portion 10*a* cannot be prevented from projecting further outward from the outside surface of the housing because of the bending of the end portions. Moreover, in order to bifurcate the tip of the latching member, the latching member must be made wider and both bifurcated end portions must be provided with a specified strength. Therefore, when the contact is inserted in the passageway, a stronger insertion force is required to deform the latching member, and thus a problem arises in that a stronger force is required to insert the contact. Also, since the bending of the bifurcated portions must be precise, a problem arises in that the control of the bending may cause difficulties during manufacturing.

SUMMARY OF THE INVENTION

In consideration of the above-mentioned problems, the object of this invention is to provide a contact having a resilient latching member which will retain the contact in the housing without projecting outward when a strong pulling force is exerted on the contact through a wire, and which will require less force to insert the contact in the housing.

The electrical connector of the present invention comprises a dielectric housing having a passageway extending therethrough and a latching aperture in communication with the passageway. An electrical contact is positioned in the passageway and includes a resilient latch member that has a free end disposed in the latching aperture to retain the contact in the passageway. A projection extends outwardly from the latch member for engagement with an inside surface of the housing so that when a force opposite to the direction of insertion of the contact into the housing is applied to the contact the free end of the latch member is prevented from projecting beyond the outside surface of the housing.

BRIEF DESCRIPTION OF THE DRAWINGS

FIG. 1 is a perspective view of the connector according to this invention;

FIG. 2 is a cross-sectional view showing the connector along the line II—II in FIG. 1;

FIG. 3 is a cross-sectional view showing the connector with the contact inserted completely inside the housing and the wires are connected with the terminating portion of the contact;

DETAILED DESCRIPTION OF THE INVENTION

Figure 4:
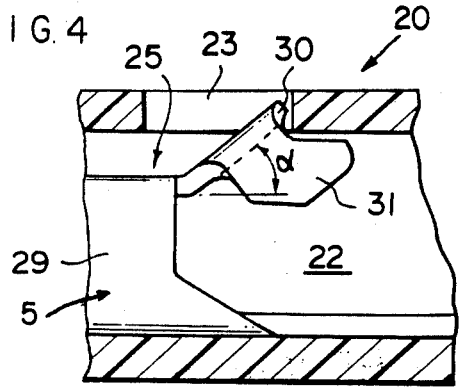
FIG. 4 is a part enlarged cross-sectional view of the resilient latching member of the connector in FIG. 3.

The following is a detailed description of the preferred embodiment of the present invention, with reference to the accompanying drawings.

FIGS. 1–4 show connector 20 which comprises a connector housing 21 and a plurality of electrical contacts 25 which are retained in passageways 22 formed in the housing 21. Each contact 25 includes receptacle portion 29, connecting portion 27 to which the end portion of an electrical wire is connected, and clamp 28 which clamps onto the wire when connected. The contact assembly is composed of a plurality of contacts 25 retained in a row by carriers 26. FIG. 1 shows the contact assembly which is partly inserted in the housing. In FIGS. 1 and 2, only the receptacle portion 29 of each contact 25 is inserted in the passageway 22, and the connecting portion 27 and clamp 28 are exposed outside. At this time, the free end of resilient latching member 30 formed on each contact 25, is disposed within temporary holding aperture 24, thereby retaining the contacts 25 at this position. Further, a projection 31, which is an integral part of the latching member 30 and bent at a right angle to the latching member 30, is formed at the side portion of resilient latching member 30. Projection 31 is disposed within the passageway 22.

In connecting wires A to contacts 25, the wires are press-fitted into slots of the connecting portions 27 so that the wires are electrically connected with the connecting portions and retained therein. Next, the clamps 28 are bent over and around the wires A, so that the wires A are firmly retained in the contacts 25 by the clamps 28. Then, as shown in FIG. 3, the contacts 25 are completely inserted inside the passageways 22. At this time, the free ends of resilient latching members 30 project into the latching apertures 23 formed in the housing 21, and accordingly, the contacts 25 are retained in the housing passageways. Furthermore, at this time, the projections 31 are disposed inside the passageways and engage with the inside walls of the passageways 22.

When the connector 20 mates with a complementary connector and the pins thereof engage with the receptacle portions 29 of the contacts 25, an electrical connection between both connectors is realized. Moreover, at this time, a projection 41 of a latching arm 40 formed at the bottom surface of the housing 21 engages with the housing of the complementary connector thereby retaining both housings in the mated condition.

Next, the case where a pulling force is exerted in a direction opposite to the insertion direction of the contacts upon the wires A is considered with reference to FIG. 4. If tension is applied to the wire in FIG. 4, the free end of resilient latching member 30 may project outward from the latching aperture 24. However, the projection 31 counteracts the tension by engaging with the inside surface of the housing 21, therefore, the free end of resilient latching 30 is prevented from projecting outward beyond the outside surface of the housing.

Figure 5:
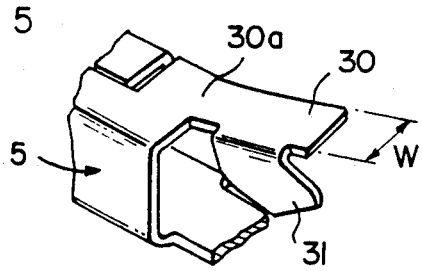
FIG. 5 is a part perspective view of the contact when removed from the connector.
Figure 8:
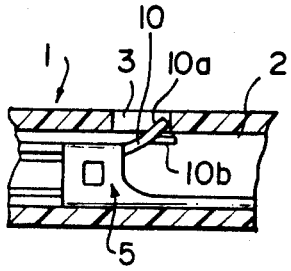
Figure 6:
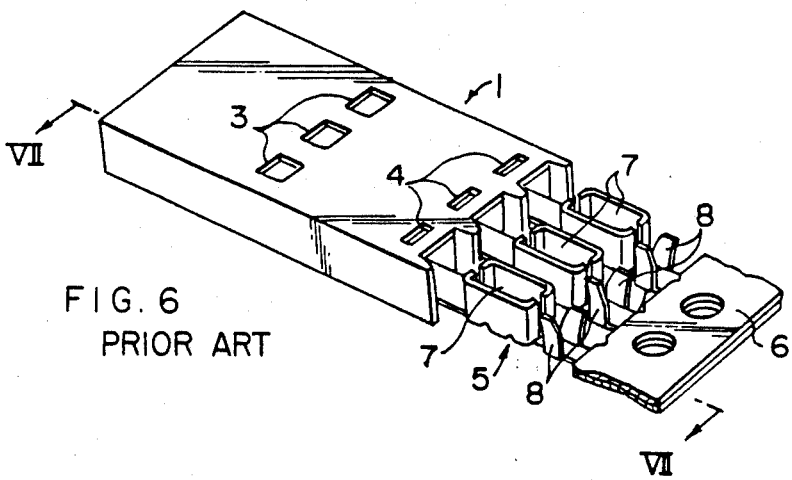
FIG. 6 PRIOR ART
FIG. 6 is a perspective view of the prior art connector.
Figure 7A:
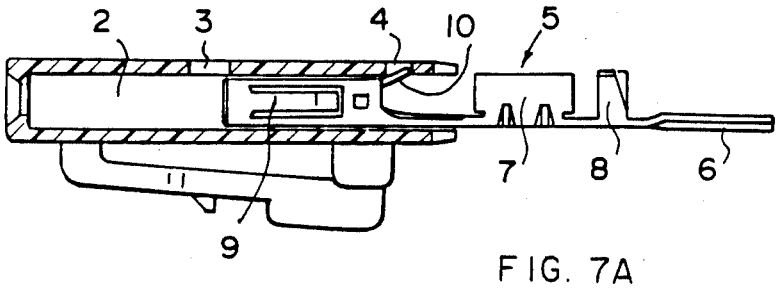
FIG. 7A PRIOR ART
FIGS. 7A and 7B are cross-sectional views showing the connector along the line VII—VII in FIG. 6; and, FIG. 8 is an enlarged cross-sectional view of the resilient latching member of another prior art connector.
Figure 7B:
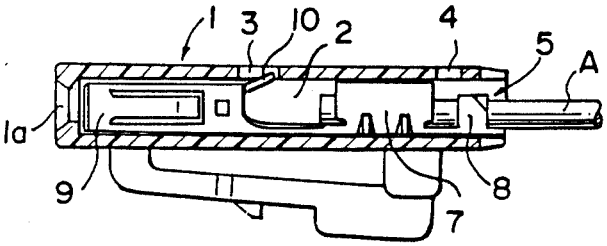
FIG. 7B PRIOR ART

Also, as shown in FIG. 5, the width W of the resilient latching member 30 can be the same as that of the resilient latching member 10 of the conventional connector shown in FIGS. 7A and 7B. Accordingly, the width of the portion 30*a* where the elastic deformation is created at the time of inserting the contact is reduced, and therefore, less force is needed to insert the contacts into the cavity. Furthermore, even if the angle $\alpha$ at which the resilient latching member 30 is bent upward is larger than usual as shown in FIG. 4, no problem will arise because the free end of the resilient latching member 30 is prevented from being projected outward from the latching aperture by the projection 31 engaging the inside surface of the housing. Therefore, an advantage is obtained whereby the bending of the resilient latching lance is simplified.

As disclosed above, according to this invention, because the projection is formed integrally with the resilient latching member, which is inserted in and engaged with the housing, the free end of the resilient latching member is prevented from projecting outward even when a pulling force is exerted on the contact in a direction opposite to the insertion direction. Further, the width of the resilient latching member can be kept small, and thus only a small force is needed to insert the contact into the housing.

I claim:

1. An electrical connector, comprising:

a dielectric housing having passageway means extending therethrough and latching aperture means disposed therein;

electrical contact means disposed in said passageway means and having resilient latching member means, said latching member means extending from the contact means to free end means and having free side edges, said free end means of said latching member means being disposed in said latching aperture means; and projection means extending from one of said free side edges on said latching member means adjacent said free end means and not being directly attached to said contact means, for engagement with an inside surface of the housing so that if a force is applied to the contact means opposite to the direction of insertion of the contact means into the passageway means, the projection means will prevent the free end means of the latching member means from projecting beyond the outside surface of the housing.

2. An electrical contact for insertion into a passageway of a dielectric housing, comprising:

a contact section for electrical engagement with a matable electrical contact;

a terminating section for termination to an electrical conductor;

a resilient latching member as part of said electrical contact, said latching member extending from said electrical contact to a free end and having free side edges, said free end of said latching member being disposable within an aperture of the housing to maintain the contact in the passageway; and a projection extending from one of said free side edges on the latching member adjacent said free end thereof and not being directly attached to said contact means, for engagement with an inside surface of the housing so that if a force is applied to the contact opposite to the direction of insertion of the contact into the passageway, the projection will prevent the free end of the latching member from projecting beyond the outside surface of the housing.

3. An electrical connector, comprising:

a dielectric housing having passageway means extending therethrough and latching aperture means disposed therein;

electrical contact means disposed in said passageway means and having resilient latching member means, free end means of said latching member means disposed in said latching aperture means; and projection means on and extending substantially normal to said latching member means adjacent said free end means for engagement with an inside surface of the housing so that if a force is applied to the contact means opposite to the direction of insertion of the contact means into the passageway means, the projection means will prevent the free end means of the latching member means from projecting beyond the outside surface of the housing.

4. An electrical contact for insertion into a passageway of a dielectric housing, comprising:

a contact section for electrical engagement with a matable electrical contact;

a terminating section for termination to an electrical conductor;

a resilient latching member as part of said electrical contact with a free end of said latching member disposable within an aperture of the housing to maintain the contact in the passageway; and a projection on and extending substantially normal to the latching member adjacent said free end thereof for engagement with an inside surface of the housing so that if a a force is applied to the contact opposite to the direction of insertion of the contact into the passageway, the projection will prevent the free end of the latching member from projecting beyond the outside surface of the housing.

* * * * *